US005632319A

United States Patent [19]

Yang et al.

[11] Patent Number: 5,632,319

[45] Date of Patent: May 27, 1997

[54] METHOD FOR MANUFACTURING ENVIRONMENTALLY CONSCIOUS FOAMED ALUMINUM MATERIALS

[75] Inventors: Chin-Chen Yang; Shan-Chang Chueh, both of Taipei; Kou-Chang Su, Kaoshing; Ting-Huey Chiou, Hsinchu, all of Taiwan

[73] Assignee: Industrial Technology Research Institute, Hsinchu, Taiwan

[21] Appl. No.: 538,883

[22] Filed: Oct. 4, 1995

[51] Int. Cl.[6] ..... B22D 27/00

[52] U.S. Cl. ..... 164/79; 75/415

[58] Field of Search ..... 164/79; 75/415

[56] References Cited

U.S. PATENT DOCUMENTS

| | | | |
|---|---|---|---|
| 3,671,221 | 6/1972 | Berry | 75/415 |
| 3,725,037 | 4/1973 | Berry et al. | 75/415 |
| 4,713,277 | 12/1987 | Akiyama et al. | 428/131 |

FOREIGN PATENT DOCUMENTS

| | | | |
|---|---|---|---|
| 659741 | 3/1963 | Canada | 75/415 |

*Primary Examiner*—Kuang Y. Lin

*Attorney, Agent, or Firm*—W. Wayne Liauh

[57] ABSTRACT

A process for making high-quality foamed aluminum articles is disclosed. This process comprises the step of: (a) placing a raw aluminum feedstock into a mold, the raw aluminum feed stock contains at least 50 wt % spent (i.e., recycled) aluminum and does not contain any extraneous viscosity enhancing agent such as metallic calcuim or magnesium; (b) heating the mold so as to melt the raw aluminum feedstock to form a liquid aluminum mass; (c) stirring the liquid aluminum mass in open air to increase its viscosity by a factor of at least about 1.3 to 1.8; (d) adding a foaming agent into the liquid aluminum mass; (e) continuing stirring the liquid aluminum mass containing the foaming agent so as to generate and uniformly distribute gas bubbles inside said liquid aluminum mass; and (f) cooling and solidifying the liquid aluminum mass to room temperature so as to form the foamed aluminum article. In a preferred embodiment, recycled foamed aluminum materials are used as the raw aluminum feedstock. The foamed aluminum article has a porosity of at least 80%, a specificity density of no greater than 0.45, and an average pore size between 3 and 6 min. Because the process is self-thickening, and no extraneous thickeners such as calcium metal are needed, great economic benefits can be obtained without adversely affecting the quality of the final product.

19 Claims, 1 Drawing Sheet

METHOD FOR MANUFACTURING ENVIRONMENTALLY CONSCIOUS FOAMED ALUMINUM MATERIALS

FIELD OF THE INVENTION

The present invention relates to a method for making high-quality foamed aluminum materials. More specifically, the present invention relates to methods for manufacturing high-quality foamed aluminum materials, or porous aluminum articles, which can be used as environmentally conscious substitutes for pathogenic building construction materials such as polyurethane foams and glass wools, at substantially lowered manufacturing cost.

BACKGROUND OF THE INVENTION

In many parts of the world, especially in the near-developed countries such as Taiwan, Korea, Singapore, etc., foamed polyurethanes and glass wools are widely used as sound-shielding and/or fireproofing materials in building constructions and/or interior designs. In these countries, because space is at a premium, the amount of living space that can be allocated to each household is far smaller than that in the U.S, and there are very few of the so-called single family homes. As a consequence, good sound-shielding and fireproof abilities of the construction material are essential for family safety and quiet enjoyment.

Most of the sound-shielding and fireproofing materials such as the foamed polyurethanes and glass wools mentioned above can emit fiber, dust, and other unwelcome particles which can be pathogenic to the human body. Furthermore, these materials are not recyclable, and their wide usage can cause serious word-wide pollution concerns. Therefore, it is paramount that we develop viable substitutes which can minimize or eliminate most, if not all, of these problems, while retaining their sound-shielding and fireproofing capability.

Foamed aluminum materials, or porous aluminum materials, have been developed in recent years as such substitutes. Foamed aluminum materials are formed by adding a foaming agent to a molten aluminum during manufacturing so as to generate gas bubbles therein. The gas bubbles are retained in the molten aluminum during solidification so as to form a highly porous aluminum material. For building construction use, the foamed aluminum typical contains 80% or more of the porous space (i.e., a porosity of at least 80%). Because of their ultra-light weight, and their fireproof and sound-shielding capability, foamed aluminum materials can be used in music halls, disco bars, karaoks, factories, indoor sporting facilities, highway sound shields, automobile bumpers, etc. The manufacturing of a foamed aluminum includes two important considerations. First, the foaming agent must be able to generate the desired amount of gas bubbles of desired sizes. Second, the molten aluminum must possess a certain viscosity so that the gas bubbles generated will be retained in the aluminum matrix during solidification. However, the viscosity of the molten aluminum cannot be too high, so as not to impede the uniform distribution of the gas bubbles.

In Japan Patent Laid-Open Publication JP51-44084, it is disclosed a method by which 1~2.5 wt % of a viscosity-enhancing agent magnesium was added to a molten pure aluminum, and 0.15~5 wt % of titanium hydride was used as the foaming agent. The foamed aluminum formed according to this method exhibited a porosity of 30~60 and a specific density of 0.6~1.5. Because of its relatively low porosity, this product is not economically attractive.

In Japan Patent Laid-Open Publication JP54-127838, it is disclosed a method by which the viscosity of the molten aluminum was enhanced by introducing air into the molten aluminum pot, and crystalline water-containing volcanic ash was used as a foaming agent. Since volcanic ash is not widely available, this method has only limited use. Furthermore, large amounts of air are required in order to reach the desired viscosity. This makes the process relatively time consuming and expensive.

In Japan Patent Publication JP57-53425, it is disclosed a method by which the viscosity of the molten aluminum was enhanced by introducing air into the molten aluminum pot, and crystalline water-containing $5CaO{\cdot}6SiO_2{\cdot}6H_2O$ was used as the foaming agent. The foamed aluminum exhibited a specific density of 0.64, and the pore size (average diameter of the pores) was less than 2 min. Again, large amounts of air are required in order to reach the desired viscosity; this makes the process relatively uneconomical. Furthermore, this process does not achieve high foaming efficiency, and thus is not very commercially attractive.

In Japan Patent Publication JP62-20846, which is contained in the same disclosure as EPO-21803 and U.S. Pat. No. 4,713,277, it is disclosed a method by which 0.2~8 wt % calcium was used as the thickener (i.e., viscosity-enhancing agent), and 1~3 wt % titanium hydride was used as the foaming agent. The porosity of the foamed aluminum can achieve 85% or better using this method. However, because this method involves the step of adding calcium metal to the molten aluminum pot, it can cause operational difficulties when relatively large size objects (greater than $30{\times}30\ cm^2$) are to be made.

From the above discussions, it is apparent that all the methods that are currently available have their shortcomings, in that they either do not produce foamed aluminums of high enough porosity (i.e., only 30 to 60%, with a specific density between 0.6 and 1.5), or that the methods are not suitable for commercial productions. Furthermore, all these processes disclosed in the prior art require the use of fresh (i.e., new) aluminum material, resulting in relatively high production cost. Therefore, there exists a strong need to develop improved processes for manufacturing foamed aluminum materials that can be used, in an environmentally-conscious and cost-effective manner, to provide sound-shielding and fireproofing in building constructions and interior designs.

SUMMARY OF THE INVENTION

The primary object of the present invention is to develop an improved process for manufacturing foamed aluminum. More specifically, the primary object of the present invention is to develop an improved process for manufacturing foamed aluminum materials, or porous aluminum articles, which exhibit a porosity of 80% or greater and can be used as excellent sound-shielding and fireproofing materials in building constructions and interior designs. Not only the foamed aluminum materials are excellent non-pathogenic and environmentally conscious substitutes for polyurethane foams and/or glass wools, the process disclosed in the present invention for making these foamed aluminum materials itself is also environmentally conscious.

In the process disclosed in the present invention, spent (i.e., waste or to-be-recycled) aluminum materials, either alone or with additional fresh (i.e., new) aluminum, are added into a mold, in which the aluminum materials are melted by heating and mixed with a foaming agent, such as titanium hydride. The mixture, which contains the aluminum feedstock and the foaming agent, is stirred in open air. The foaming agent cause gas bubbles to be generate in the molten mixture. A viscosity enhancing agent is required so as to attain a desired viscosity of the molten aluminum and retain the gas bubbles. It is found that in the process disclosed in the present invention, the recycled aluminum materials, which contain aluminum oxide, provide the function as an excellent self-viscosity enhancer (about 1.3~1.8 times the viscosity of an equivalent molten aluminum without the viscosity enhancing agent). The process disclosed in the present invention distinguishes from those of the prior art in that a only very short stirring time, about 3 to 6 minutes, is required to achieve the desired viscosity, and that it does not require extraneous thickeners such as calcium and magnesium metals required in the prior art processes. With the process disclosed in the present invention, the foamed aluminum materials exhibited a porosity exceeding 85%, a specific density less than 0.4, and a very uniform pore size distribution (between about 3~6 mm in diameter).

In the process disclosed in the present invention, the recycled aluminum materials can be either recycled foamed aluminum or recycled aluminum cans, or other recycled aluminum objects such as recycled aluminum auto parts including recycled aluminum wheels. An important criterion is that the recycled aluminum should contain preferably at least about 1,000 ppm, or more preferably at least 0.5~10 wt %, or most preferably at least 3~10 wt %, of aluminum oxide. After stirring, the aluminum oxide film contained in the recycled aluminum diffused into the molten aluminum matrix to provide an unexpectedly excellent viscosity enhancing effect. Preferably, the recycled materials contain a large surface so as to maximize the amount of aluminum oxide that can be provided.

Because the process disclosed in the present invention does not require the step of adding a metallic viscosity enhancer, it greatly simplifies the operation procedure and equipment, and can be easily implemented in large-scale commercial productions. Furthermore, because the present invention allows the direct use of waste aluminum without having to remove aluminum oxide, this, coupled with the factors that it does not require any foreign viscosity enhancer and the process only requires very short stirring time, allows the cost of manufacturing the foamed aluminum materials to be greatly reduced. The lowered cost of the foamed aluminum materials produced from the process disclosed in the present invention will enable a more ready acceptability as environmentally conscious substitutes for the pathogenic polyurethane foams and/or glass wools in building construction and interior embellishments.

BRIEF DESCRIPTION OF THE DRAWING

The present invention will be described in detail with reference to the drawing showing the preferred embodiment of the present invention, wherein.

DETAILED DESCRIPTION OF THE PREFERRED EMBODIMENT

Figure 1:
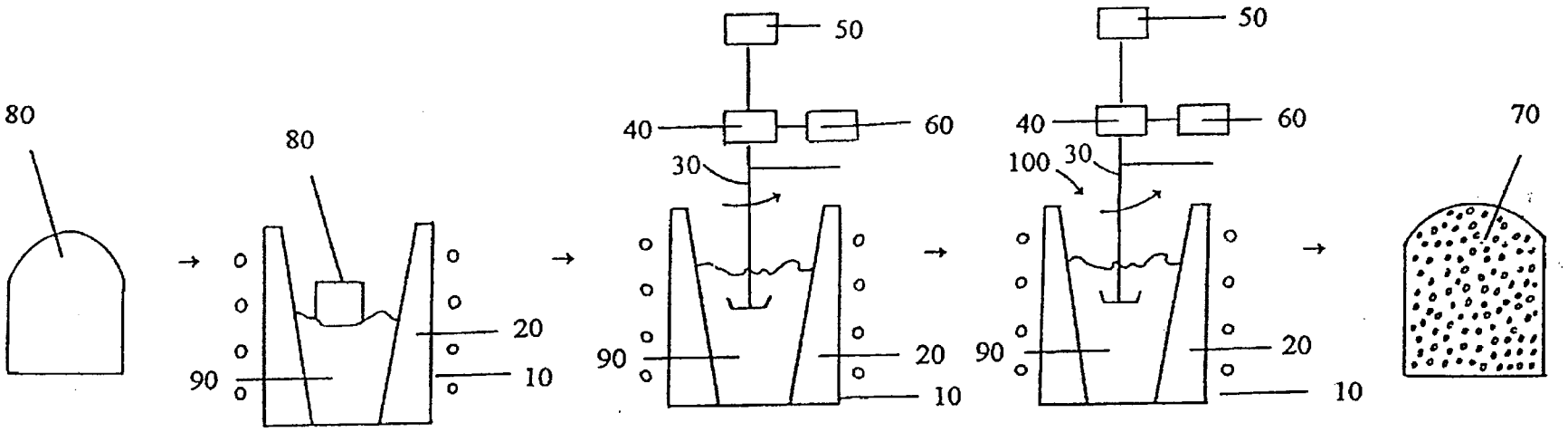
FIG. 1 is schematic flow chart showing the steps of the process disclosed in the present invention.

The present invention discloses an improved process for manufacturing high-quality foamed aluminum. With the process disclosed in the present invention, high-quality foamed aluminum materials, or porous aluminum articles, can be produced which exhibit a porosity of 85% or greater and can be used as excellent sound-shielding and fireproofing materials in building constructions and interior decorations. Not only that the foamed aluminum materials themselves provide excellent non-pathogenic and environmentally conscious substitutes for polyurethane foams and/or glass wools, the process disclosed in the present invention for making these foamed aluminum materials itself is also environmentally conscious.

In the process disclosed in the present invention, waste (i.e., to be recycled) aluminum materials, either alone or with additional fresh (i.e., new) aluminum, are added into a mold, in which the aluminum materials are melted, stirred, and mixed with a foaming agent. The recycled aluminum materials contain aluminum oxide, which provides the function as an excellent self-viscosity enhancer for the molten aluminum mass. A preferred foaming agent is titanium hydride. And the preferred amount of the foaming agent to be added is about 0.1 to 3 wt %. The mixture, which contains the aluminum materials and the foaming agent, is stirred in open air. Gas bubbles are generated as a result of the foaming agent. With the process disclosed in the present invention, only a very short stirring time is required to achieve the desired viscosity. Typically, a stirring time of only about 3 to 6 minutes is required. Such a substantial reduction in the stirring time at elevated temperatures (i.e., above the melting point temperature of aluminum) not only accelerates the manufacturing process, it also greatly reduces the energy cost for manufacturing the foamed aluminum materials. Furthermore, the process disclosed in the present invention is self-thickening, and it does not require other thickeners such as calcium or magnesium metal to be added to the molten mass. This further simplifies the manufacturing procedure and decreases the raw material cost, resulting in a further reduction of the cost of foamed aluminum materials.

A distinct advantage of the process disclosed in the present invention is that, it can substantially reduce the manufacturing cost without incurring any degradation in the quality of the final products. Indeed, very high quality foamed aluminum materials can be produced at substantially lowered cost. The foamed aluminum materials produced from the process disclosed in the present invention are better than, or at least as good as, the best competitive products that are currently available. With the process disclosed in the present invention, the foamed aluminum materials exhibited a porosity exceeding 85%, a specific density less than 0.4, and a very uniform pore size distribution (between about 3~6 mm in diameter).

In the process disclosed in the present invention, the recycled aluminum materials can be either recycled foamed aluminum, recycled aluminum cans, recycled aluminum auto parts, or other recycled aluminum products. An important criterion is that the recycled aluminum must contain a substantial surface area such that it preferably contains preferably at least about 1,000 ppm, or more preferably at least 0.5~10 wt %, or most preferably at least 3~10 wt %, of aluminum oxide. After stirring, the aluminum oxide film contained in the recycled aluminum will diffuse into the molten aluminum matrix to provide an unexpectedly excellent viscosity enhancing effect. Preferably, the recycled materials alone are used as the aluminum feedstock so as provide the maximum amount of aluminum oxide. However, if the amount of recycled aluminum does not satisfy consumer need, fresh aluminum can be mixed with the recycled materials in the feed stream.

The present invention will now be described more specifically with reference to the following example. It is to be noted that the following descriptions of examples, including the preferred embodiment of this invention, are presented herein for purposes of illustration and description, and are not intended to be exhaustive or to limit the invention to the precise form disclosed.

FIG. 1 is a schematic flow chart describing the various steps of a preferred embodiment of the process disclosed in the present invention. Step A shows the recycled foamed aluminum materials 80. In Step B; the recycled aluminum materials were first added into a mold 10, which was heated by a heater 20 at a temperature of about 620° C., so as to form a molten aluminum mass 90. The temperature of the heater typically was higher with a greater amount of aluminum oxide. Step C shows that the molten aluminum mass 90 was stirred, using a motor 50 to drive a rotor 40 affixed with a shaft 30 at a medium rpm and maintained at a constant temperature above the melting point of aluminum for three to six minutes. A torque sensor 60 is attached to the rotor to provide an indication of the viscosity of the molten mass 90. During stirring, the viscosity of the molten aluminum mass 90 was increased, as a result of the microscopic aluminum oxide diffusing into the molten maxtrix. When the viscosity of the molten aluminum pot 90 was increased to about 1.6 times of the initial viscosity, the stirring rate was changed to high speed, and 1 wt % of 99% pure titanium hydride particles 100 with an average diameter of 5~10 μm were added, as shown in Step D. The amount of titanium hydride can range from 0.1 to 3 wt %. Also, other foaming agents such as zirconium oxide can also be used. Many of the foaming agents have been taught in the art and will not be repeated here.

After further homogenizing, the stirring rod was lifted from the molten aluminum mass, which was then maintained at a constant temperature. Hydrogen bubbles were formed as a result of the addition of the foaming agent of titanium hydride. The increased viscosity as a result of the diffusion of the aluminum oxide particles into the molten aluminum matrix effectively caused the gas bubbles to be retained and uniformly distributed in the aluminum matrix. After cooled to room temperature, a high-quality foam aluminum product having a porosity of 85-plus % and a specific density of 0.4 was formed, as shown in Step E.

Other recylced aluminum alloys were also tested, including AC2A (auto or motorcycle parts), ADC6 (from switch boxes of motorcycles) and ADC12 (auto or motorcycle parts and household appliances). The metallic components of these aluminum alloys were tested using atomic analysis and the results are shown in Table 1 below:

TABLE 1

| non-aluminum element | AC2A | ADC6 | ADC12 |
|---|---|---|---|
| Cu | 3.94% | <0.5% | 1~2% |
| Mg | <0.5% | 3.11% | <0.5% |
| Si | <0.5% | <0.5% | 11.2% |

High quality foamed aluminum materials were also used from these recycled aluminum alloys. However, recycled foamed aluminum is preferred because it contained the maximum amount of surface and thus the maximum amount of aluminum oxide.

It was found during the course of this invention that, if the stirring time was less than three minutes, the molten aluminum would incur an unfavorably too fast a rate of solidification, especially in the portions near the walls of the mold. This resulted in the uneven polarization of the gas bubbles that were concentrated in the central portion of the molten aluminum pot. It was found that six minutes was the optimum stirring time. Furthermore, it was found that one percent of titanium hydride was able to produce a porosity of 85% with a pore size distribution between 3~6 min. If the amount of titanium hydride was less than 0.1 wt %, not enough gas bubbles were generated. Maximum amounts of gas bubbles can be generated when the amount of titanium hydride was about 3 wt %.

It should be noted that the main object of the present invention is to use recycled aluminum as a self-thickening agent during the molten state, without having to use any foreign viscosity enhancer, such as the metallic calcium or magnesium. A large variety of foaming agents can be used in the present invention. The titanium hydride was used in the preferred embodiment primarily it was readily available in the market.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A process for making high-quality foamed aluminum articles comprising the step of:

(a) placing a raw aluminum feedstock into a mold, said raw aluminum feed stock contains at least 50 wt % spent aluminum and does not contain any extraneous viscosity enhancing agent;

(b) heating said mold so as to melt said raw aluminum feedstock to form a liquid aluminum mass;

(c) stirring said liquid aluminum mass in open air until its viscosity is increased by a factor of from about 1.3 to 1.8;

(d) adding a foaming agent into said liquid aluminum mass;

(e) continuing stirring said liquid aluminum mass containing said foaming agent so as to generate and uniformly distribute a plurality of gas bubbles inside said liquid aluminum mass; and (f) cooling and solidifying said liquid aluminum mass to room temperature so as to form a foamed aluminim article, wherein said foamed aluminim article has a porosity of at least 80%, a specific density of no greater than 0.45, and an average pore size between 3 and 6 mm.

2. A process for making high-quality foamed aluminum articles according to claim 1 wherein said foamed aluminim article has a porosity of at least 85%.

3. A process for making high-quality foamed aluminum articles according to claim 1 wherein said foamed aluminim article has a specific density of no greater than 0.40.

4. A process for making high-quality foamed aluminum articles according to claim 1 wherein said raw aluminum feedstock consists entirely of spent aluminum.

5. A process for making high-quality foamed aluminum articles according to claim 1 wherein said spent aluminum contains at least 1,000 ppm of aluminum oxide.

6. A process for making high-quality foamed aluminum articles according to claim 1 wherein said spent aluminum contains at least 0.5 to 10 wt % of aluminum oxide.

7. A process for making high-quality foamed aluminum articles according to claim 1 wherein said spent aluminum contains at least 3 to 10 wt % of aluminum oxide.

8. A process for making high-quality foamed aluminum articles according to claim 1 wherein said spent aluminum is a recylced foamed aluminum.

9. A process for making high-quality foamed aluminum articles according to claim 1 wherein said foaming agent is titanium hydride.

10. A process for making high-quality foamed aluminum articles according to claim 9 wherein said foaming agent is added in an amount of 0.1 to 3 wt %.

11. A process for making high-quality foamed aluminum articles comprising the step of:

(a) placing a raw aluminum feedstock into a mold, said raw aluminum feed stock consists of aluminum and at least 1,000 ppm aluminum oxide;

(b) heating said mold so as to melt said raw aluminum feedstock to form a liquid aluminum mass;

(c) stirring said liquid aluminum mass in open air until its viscosity is increased by a factor between 1.3 and 1.8;

(d) adding a foaming agent into said liquid aluminum mass;

(e) continuing stirring said liquid aluminum mass containing said foaming agent so as to generate and uniformly distribute a plurality of gas bubbles inside said liquid aluminum mass; and (f) cooling and solidifying said liquid aluminum mass to room temperature so as to form a foamed aluminim article, wherein said foamed aluminim article has a porosity of at least 80%, a specificity density of no greater than 0.45, and an average pore size between 3 and 6 mm.

12. A process for making high-quality foamed aluminum articles according to claim 11 wherein said foamed aluminim article has a porosity of at least 85%.

13. A process for making high-quality foamed aluminum articles according to claim 11 wherein said foamed aluminim article has a specificity density of no greater than 0.40.

14. A process for making high-quality foamed aluminum articles according to claim 11 wherein said raw aluminum feedstock consists entirely of spent aluminum.

15. A process for making high-quality foamed aluminum articles according to claim 11 wherein said raw aluminum feedstock contains 0.5 to 10 wt % of aluminum oxide.

16. A process for making high-quality foamed aluminum articles according to claim 11 wherein said raw aluminum feedstock contains 3 to 10 wt % of aluminum oxide.

17. A process for making high-quality foamed aluminum articles according to claim 11 wherein said spent aluminum is a recylced foamed aluminum.

18. A process for making high-quality foamed aluminum articles according to claim 11 wherein said foaming agent is titanium hydride.

19. A process for making high-quality foamed aluminum articles according to claim 18 wherein said foaming agent is added in an amount of 0.1 to 3 wt %.

* * * * *